United States Patent [19]

Isozumi

[11] Patent Number: 4,907,464

[45] Date of Patent: Mar. 13, 1990

[54] COAXIAL STARTER

[75] Inventor: Shuzoo Isozumi, Hyogo, Japan

[73] Assignee: Mitsubishi Denki Kabushiki Kaisha, Tokyo, Japan

[21] Appl. No.: 251,644

[22] Filed: Oct. 3, 1988

[30] Foreign Application Priority Data

Oct. 1, 1987 [JP] Japan ..... 62-248429
Oct. 1, 1987 [JP] Japan ..... 62-248430
Oct. 7, 1987 [JP] Japan ..... 62-252983

[51] Int. Cl.[4] ..... F02N 15/06

[52] U.S. Cl. ..... 74/7 A; 74/7 E; 290/48; 310/83; 310/249; 335/131

[58] Field of Search ..... 74/7 A, 7 E; 290/48; 310/83, 249; 325/131

[56] References Cited

U.S. PATENT DOCUMENTS 4,507,978 4/1985 Tanaka et al. ..... 74/7 E
4,613,761 9/1986 Yabunaka ..... 290/36 R
4,671,125 6/1987 Yabunaka ..... 74/7 E

FOREIGN PATENT DOCUMENTS 446427 1/1948 Canada ..... 74/7 A
1311876 11/1962 France .
WO88/02567 4/1988 PCT Int'l Appl. .
944887 11/1961 United Kingdom .
2125928 3/1984 United Kingdom ..... 74/7 E

OTHER PUBLICATIONS

European Search Report for European Application EP-88116170 (Report dated Jan. 4, 1987).

*Primary Examiner*—Allan D. Herrmann
*Attorney, Agent, or Firm*—Sughrue, Mion, Zinn, Macpeak & Seas

[57] ABSTRACT

A coaxial starter which includes a motor having a tubular armature shaft to which an armature and a commutator are attached; an output shaft arranged at the front end side of the motor and having one end provided with a pinion disengageably engaged with a ring gear of an engine and the other end inserted into the inside path of the tubular armature shaft so as to be axially slidable, the output shaft having a large-diameter portion thereof; a driving power transmission device having an overrunning clutch for transmitting rotation force of the armature shaft through the overrunning clutch to the output shaft; a bearing provided between a front end surface of the armature shaft, perpendicular to the axial direction thereof and the end surface of the large-diameter portion of the output shaft; and an electromagnetic switching unit provided on a rear end side of the motor for energizing the motor and for sliding the output shaft.

7 Claims, 4 Drawing Sheets

COAXIAL STARTER

BACKGROUND OF THE INVENTION

The present invention relates to a coaxial starter and, more particularly to a coaxial starter used for starting an engine of a vehicle.

Heretofore, the coaxial starter for use in the engine of the vehicle has been constructed as shown in FIG. 5.

The conventional starter 1 as shown in FIG. 5 is constituted mainly by a DC motor 2, an overrunning clutch 4 slidably mounted on an output shaft 3, a gear train 5 for reducing the rotation force of an armature shaft 2*a* of the DC motor 2 to be transmitted to a clutch outer portion 4*a* of the overrunning clutch 4 through the output shaft 3, and a shift lever 8 having one end engaged with a plunger rod of an electromagnetic switching unit 6 arranged on a side of the DC motor 2 and having the other end engaged with an annular member 7 attached to the overrunning clutch 4, for making the overrunning clutch 4 slide on the output shaft 3.

However, because the conventional starter 1 has a so-called biaxial structure in which the electromagnetic switching unit 6 for turning-on the power supply to the DC motor 2 is arranged on a side of the DC motor 2, the layout of the engine is very restricted when a vehicle is planned.

SUMMARY OF THE INVENTION

It is therefore an object of the present invention to eliminate the aforementioned difficulties with the conventional starter.

Another object of the present invention is to provide a coaxial starter which can prevent the abrasion both in the front end surface of the armature shaft and in the rear end surface of the large-diameter portion of the output shaft to attain high durability and reliability.

A further object of the present invention is to provide a coaxial starter in which the overall longitudinal length is reduced, regardless of the electromagnetic switching unit arranged on the rear end of the motor.

The coaxial starter according to the present invention comprises: a motor having a tubular armature shaft; an output shaft arranged at the front end side of the motor and having one end provided with a pinion disengageably engaged with a ring gear of an engine and the other end inserted into an inside path of the armature shaft so as to be axially slidable; a driving power transmission device having an overrunning clutch through which rotation force of the armature shaft is transmitted to the output shaft; a bearing provided at or in the vicinity of the front end of the armature shaft and arranged between a surface of the armature shaft perpendicular to an axial line and an end surface of a large-diameter portion formed on the output shaft; and an electromagnetic switching unit arranged at a rear end side of the motor for energizing the motor and for sliding the output shaft. The coaxial starter of the present invention further comprises: a plunger which is moved in the axial direction due to the excitation of the electromagnetic switching unit; a tubular rod which is fixed to the plunger and extending in the axial direction; a force rod which is inserted into the tubular rod and extending through an inside path of the tubular armature shaft so as to be in contact with an end surface of the output shaft; a movable contact provided on the tubular rod; a coiled spring arranged within the tubular rod to urge the force rod in the axial direction; a fixed contact which the movable contact touches; and a pair of terminal bolts which is connected to one terminal of an electric source and the motor, respectively, and attached to a frame of the motor between a plurality of brushing units arranged around the commutator located at the rear end of the motor.

According to the coaxial starter of the invention, when the electromagnetic switching unit is energized, the plunger moves. As the plunger moves, the tubular rod compresses the coiled spring arranged within the inside thereof to give thereby pressing force to the force rod. As a result, the output shaft is moved in the axial direction by the pressure of the force rod, so that the pinion engages with the engine ring gear and so that the movable contact provided in the tubular rod touches the fixed contact. Thus, the motor is powered on. As a result, the rotation force of the armature shaft is transmitted to the pinion through the one-way clutch to drive the engine. After the engine starts, the power supply for the electromagnetic switching unit is cut off so that the tubular rod returns to its original position as the plunger returns. Also, the output shaft returns to its original position. At this time, the end surface of the large-diameter portion of the output shaft is brought into contact with the end surface of the armature shaft through the bearing. The electric supply for the motor is also cut off while the pinion is disengaged from the engine ring gear by the return of the output shaft.

DETAILED DESCRIPTION OF THE PREFERRED EMBODIMENTS

Figure 6:
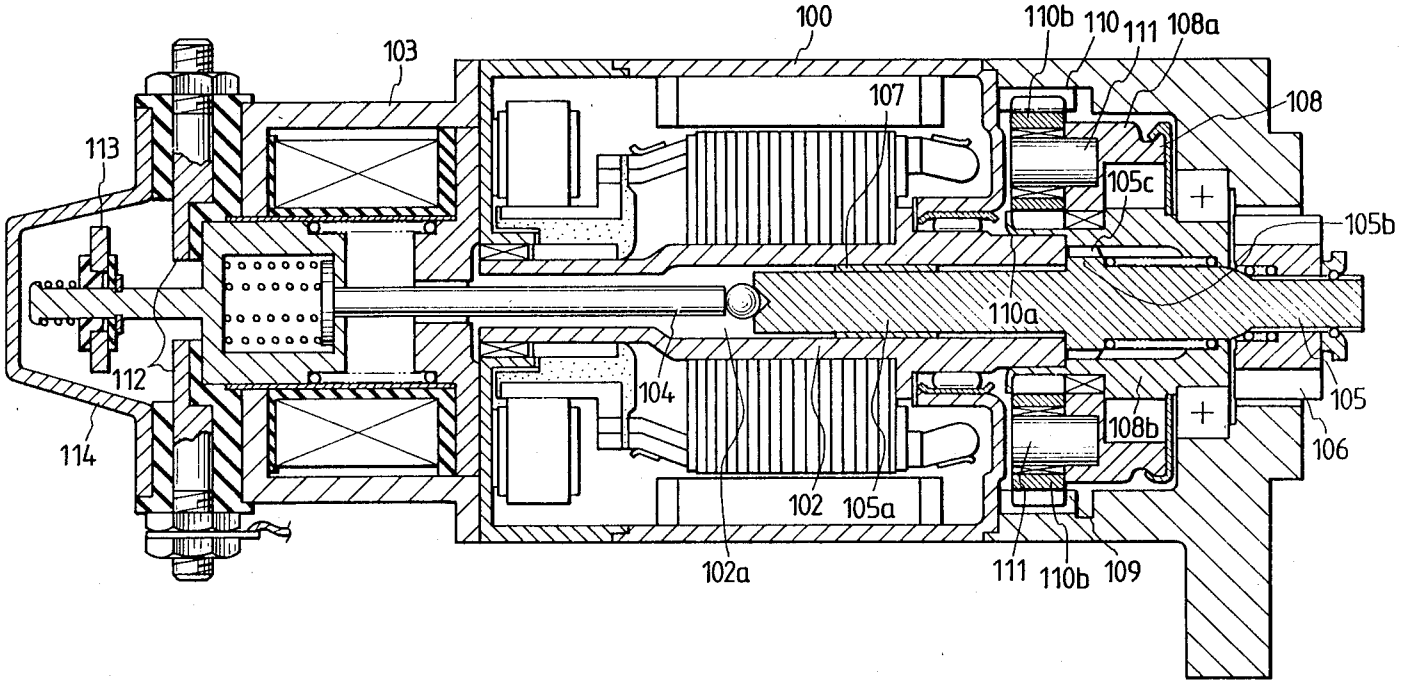
FIG. 6 shows the coaxial starter proposed by the inventors before the present invention is created.

To avoid the aforementined disadvantage with the conventional biaxial starter, it has been proposed that the electromagnetic switching unit be arranged axially on one end of the DC motor to simplify, thereby the form of the starter like a slender cylindrical matter, as shown in FIG. 6. The basic construction according to the proposal is as follows. An armature shaft 102 of a DC motor 100 is made hollow so that a force rod 104 of an electromagnetic switching unit 103, conventionally used for operating the shift lever, is allowed to extend to the output shaft 105 through an inside path 102*a* of an armature shaft 102. Because the armature shaft 102 of the DC motor 100 and the force rod 104 of the electromagnetic switching unit 103 are arranged coaxially, the starter according to the proposal is called a "coaxial starter".

Describing the specific arrangement of the coaxial starter in more detail, the output shaft 105 has a front end (right in FIG. 6) provided with a pinion 106 engaged with a ring gear of the engine and a rear end inserted into an inside path 102*a* of the armature shaft 102. The output shaft 105 is provided with an insertion shaft portion 105*a* which is supported by a sleeve bearing 107 fixedly fitted to an inner circumferential portion of the inside path 102*a* to permit the output shaft 105 to slide in the axial direction. A driving power transmission device 109 including an overrunning clutch (one-way clutch) 108 serves as a means for transmitting driving power from the armature shaft 102 of the DC motor 100 to the output shaft 105 slidable in the axial direction.

The driving power transmission device 109 is constituted by a planetary reduction gear train 110 provided in the surroundings of the front end of the armature shaft 102 and including a sun gear 110*a* and planetary gears 110*b*, and the one-way clutch 108 having a clutch outer portion 108*a* to which a central supporting shaft 111 of the planetary gears 110*b* is fixed and a clutch inner 108*b* which is engaged with a helical spline 105*c* formed on the outer circumference of a large-diameter portion 105*b* of the output shaft 105.

In the proposed coaxial starter, the rear end surface at the large-diameter portion 105*b* of the output shaft 105 is brought into direct contact with the front end surface of the DC motor 100 when the output shaft 105, having been slid forward by the force rod 104 of the electromagnetic switching unit 103 returns to its original position. Because the rotation force of the output shaft 105 in the coaxial starter is transmitted to the engine ring gear (not shown) through the pinion 106, the output shaft 105 is driven in the reverse direction by the engine at the time of engine start. The output shaft 105 rotates at a high speed until the pinion 106 is disengaged from the ring gear. However, the reverse transmission is cut off by the one-way clutch 108 for the purpose of protecting the DC motor, so that the high-speed rotation of the output shaft 105 driven by the engine has does not affect the armature shaft 102. Consequently, a large rotational difference arises between the armature shaft 102 and the output shaft 105 rotating at high speed by inertia. For this reason, heavy abrasion may occur in the aforementioned, contacting portion.

Also, a movable contact 113 is arranged to touch a fixed contact 112 provided on the rear portion of the electromagnetic switching unit 103 so that electrical power is supplied to the DC motor 100, and a cover 114 is aranged to cover the fixed contact 112 and the movable contact 113. As a result, the overall longitudinal length increases greatly, which interferes with a part of the engine.

The coaxial starter according to the present invention will be described in detail with respect to a preferred embodiment illustrated in the accompanying drawings.

Figure 1:
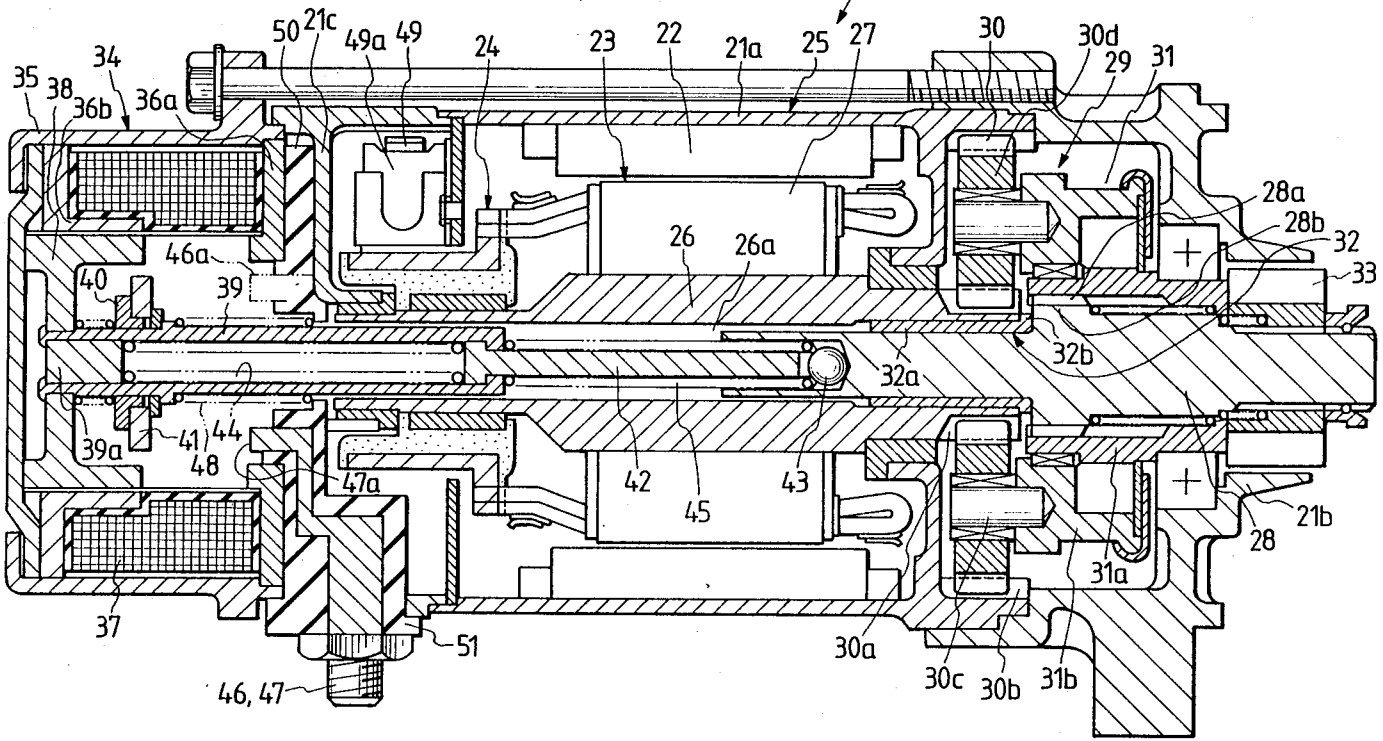
FIG. 1 shows a coaxial starter according to one embodiment of the present invention.

FIG. 1 shows an embodiment of the coaxial starter according to the present invention. In this embodiment, the coaxial starter 20 includes a DC motor 25 which comprises permanent magnets 22 arranged at intervals on the inner circumferential surface of a yoke 21*a* which forms a magnetic circuit and an outer wall, an armature 23 rotatably arranged in the central portion of the yoke 21*a, and a commutator 24 of a conventional type provided on the one-end side of the armature 23.*

The armature 23 in the DC motor 25 is constituted by a hollow armature shaft 26 and an armature core 27 attached to the outer circumference of the shaft 26. An output shaft 28 is arranged axially to the one end side of the DC motor 25, that is, to the front side (right side in FIG. 1) thereof, so that rotation force is transmitted to the output shaft 28 by a driving power transmission device 29. The driving power transmission device 29 is constituted by a planetary reduction gear train 30, an overrunning clutch 31, and a herical spline 28*b* formed on the output shaft 28 to be engaged with a clutch inner portion 31*a* of the overrunning clutch 31. The output shaft 28 is arranged coaxially with respect to the armature shaft 26 of the DC motor 25. One end of the output shaft 28 is inserted into an inside path 26*a* of the armature shaft 26 so that the output shaft 28 is axially slidably supported by a bearing (sleeve bearing) 32 disposed between the output shaft 28 and the inner circumference of the armature shaft 26.

The rotation force of the armature shaft 26 is transmitted to the output shaft 28 through the planetary reduction gear train 30 and the overrunning clutch 31. The planetary reduction gear train 30 is constituted by a sun gear 30*a* integrally formed on the outer circumference at one end of the armature shaft 26, an internal gear 30*b* formed at the inner surface of the yoke 21*a* of the motor with respect to the center of the sun gear 30*a*, and a plurality of planetary gears 30*b* engaged with the sun gear 30*a* and the internal gear 30*b*, and rotatably supported by a central supporting shaft 30*c* fixed to a clutch outer portion 31*b* of the overrunning clutch 31. The clutch inner portion 31*a* of the overrunning clutch 31 is engaged with the helical spline 28*a* formed at the outer circumference of a radially outward projecting portion 28*a* of the output shaft 28, so that the output shaft 28 is axially slid while the rotation force is received form the clutch inner portion 31*a. Accordingly, a pinion 33 attached to the front end of the output shaft 28 is projected from a front bracket 21b* by the sliding of the output shaft 28 so that the pinion 33 is engaged with a ring gear (not shown) of the engine to rotate it.

On a rear side of a rear bracket 21*c* fitted/attached to the rear end of the DC motor 25, there is provided an electromagnetic switching unit 34 to make the output shaft 28 slide, and to make the electric supply from a battery to the DC motor 25 possible through the closing of a vehicle key switch (not shown). The electromagnetic switching unit 34 includes an excitation coil 37 wound on a plastic bobbin supported by front and rear cores 36*a* and 36*b* which form a magnetic path together with a casing 35, a plunger 38 slidably arranged to a central opening portion of the bobbin, a tubular rod 39 having one end attached to the plunger 38 and the other end extending into the inside path 26*a* from the rear end of the armature shaft 26, and a movable contact 41 connected to the rod 39 through an insulator 40. A force rod 42 is slidably inserted into the inside of the tubular rod 39. The force rod 42 extends forward from the front-end opening portion of the tubular rod 39 so that the front end of the force rod 42 touches, through a steel ball 43, the innermost wall of a concavity formed at the end surface of the output shaft 28.

The rear end of the tubular rod 39 is closed to form a block portion 39*a*. A coiled spring 44 is arranged within the rod 39 so that the ends of the coiled spring 44 are fixed, respectively, to an end surface of the block portion 39*a* and an end surface of the force rod 42. As the tubular rod 39 moves, the coiled spring 44 exerts pressing force to the force rod 42, so that the coiled spring 44 exerts urging force to the output shaft 28. Because the overall longitudinal length of the coiled spring 44 can be established to be relatively long by arranging the coiled spring 44 within the tubular rod 39, a proper load can be obtained by proper spring stress. A coiled spring 48 is arranged to return the tubular rod 39 to its original position. A coiled spring 45 is also arranged to keep the steel ball 43 in a predetermined position.

As shown in FIG. 1, the bearing (such as a sleeve bearing) 32, fixedly fitted to the inner circumference in the inside path 26*a* of the armature shaft 26 to support the output shaft 28 slidably with respect to the armature shaft 26, is constituted by a tubular bearing portion 32*a* to receive a radial load of the output shaft 28, and a flange-like bearing portion 32*b* extending radially outward at the front end portion of the tubular bearing portion 32*a* flange-like bearing portion 32*b* is interposed between the front end surface of the armature shaft 26 and the end surface of the large-diameter portion of the output shaft to receive mainly a thrust load through the large-diameter portion 28*b* of the output shaft. The rear end of the tubular bearing portion 32*a* in the bearing 32 terminates in the front of where the armature shaft 26 in the motor is attached to the armature core 27. This is due to the following problems being prevented. If the bearing is extended to the mount position of the armature core, the shaft portion is often distorted when knurling is made at the central portion of the armature shaft 26 to mount the armature core thereto. Problems arise in that the pressure-receiving area of the bearing is reduced and that the force insertion of the bearing cannot be made sufficiently.

Figure 2:
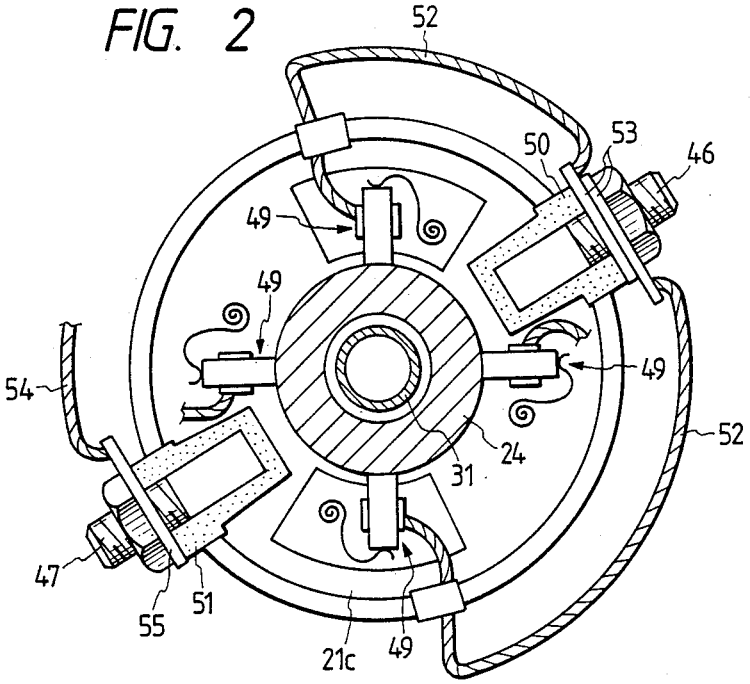
FIG. 2 shows the rear end of a DC motor used in the coaxial starter of FIG. 1 in the condition that the rear bracket has been removed.

Four brushing units 49 are arranged at equal intervals in the surroundings of the commutator 24 in the DC motor 25 as shown in FIG. 2. Furthermore, according to the present invention, two terminal bolts 46 and 47 are arranged between the brushing units 49. The terminal bolts 46 and 47 are fixed to resin brackets 50 and 51 by molding and are positioned by attaching the resin brackets 50 and 51 into cuts formed at the circumferential surface of the rear bracket 21*c, respectively. Inner ends 46a* and 47*a* of the terminal bolts 46 and 47 held by the resin brackets 50 and 51 respectively extend, through the end surface of the rear bracket 21*c*, to a space where the movable contact of the electromagnetic switching unit 34 moves, thereby forming fixed contacts which can touch the movable contact 41 when the movable contact 41 comes to a predetermined position. A pair of washers 53 with a wire 52 connected to each are fixed to the head of one terminal bolt 46 by a nut. The wires 52 are connected respectively to brushes 49*a* of a pair of brushing units 49 which are opposite to each other. Brushes 49*a* of another pair of brushing units 49 are grounded to the corresponding base plates 53. A washer 55 to which a wire 54 is connected is fixed to the head of the other terminal bolt 47 by a nut. The wire 54 is connected to the positive terminal of the battery (not shown).

The operation of the starter 20 will be described briefly below.

When a vehicle starter switch is closed, the electromagnetic switching unit 34 is energized to move the plunger 38 forward to move thereby the tubular rod 39. Then, the coiled spring 44 inside tubular rod 39 compresses to give pressing force to the force rod 42 so that the output shaft 28 is moved forward. Accordingly, the pinion 33 is engaged with the engine ring gear and, the movable contact 41 on the tubular rod 39 touches the fixed contacts 46*a* and 47*a*. Thus, the DC motor 25 can be powered on. As a result, the rotation force of the armature shaft 26 in the DC motor 25 is transmitted to the output shaft 28 through the planetary reduction gear train 30 and the overrunning clutch 31 so that the engine is driven by the rotation of the pinion 33.

When the engine starts, the electric supply for the electromagnetic switching unit 34 is cut off. Then, the output shaft 28 is returned to its original position by the return spring arranged at a suitable place so that the pinion 33 is disengaged from the engine ring gear. However, the rotation force may be transmitted reversely from the engine during the short time required for disengaging the pinion 33 from the ring gear after the start of the engine, so that the output shaft 28 may be rotated at a high speed. The overrunning clutch 31 prevents the high-speed rotation of the output shaft 28 due to the reverse transmission from the engine from being transmitted to the DC motor 25. However, when the output shaft 28 returns to its original position, the rear end surface of the large-diameter portion 28*b* is brought into contact with the end surface of the flange-like bearing portion 32*b* of the bearing 32 while the output shaft 28 rotates at a high speed. Thus, the rear end surface of the large-diameter portion 28*b* of the output shaft 28 does not touch the front end surface of the armature shaft 26 directly, because the rear end surface is brought into contact with the flange-like bearing portion 32*b*. Accordingly, abrasion of the armature shaft 26 and the output shaft 28 can be prevented. As the output shaft 28 returns, the tubular rod 39 also returns. As a result, the movable contact 41 is disconnected from the fixed contact 46 to off thereby the electric supply for the DC motor 25.

Figure 3:
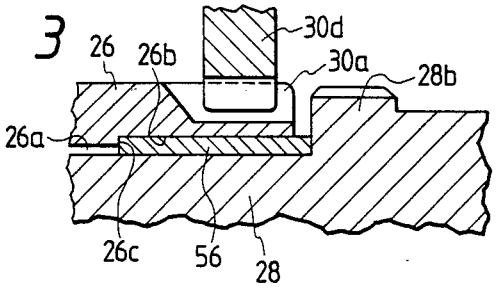
FIG. 3 is a fragmentary sectional view showing a bearing provided in the front end side of the armature shaft according to another embodiment of the present invention.

Although the above-mentioned embodiment has shown the case where the bearing 32 is constituted by the tubular bearing portion 32*a* to receive a radial load and the flange-like bearing portion 32*b* arranged in the front end outer circumference of the tubular bearing portion 32*a* to receive a thrust load, it is a matter of course that the same effect can be attained by another embodiment as shown in FIG. 3 FIG. 3 shows a large-diameter concavity 26*b* relatively long in the axial direction which is formed in the front end side of the armature shaft 26 so that a tubular bearing 56 longer in the axial direction than the large-diameter concavity 26*b* is fitted fixedly into the large-diameter concavity 26*b*. Because the bearing 56 has its front end touching the rear end surface of the large-diameter portion 28*b* of the output shaft 28 and its rear end touching the inner end surface (surface perpendicular to the axial line) 26*c* of the large-diameter concavity 26*b*, the bearing 56 can receive both a radial load and a thrust load.

Figure 4:
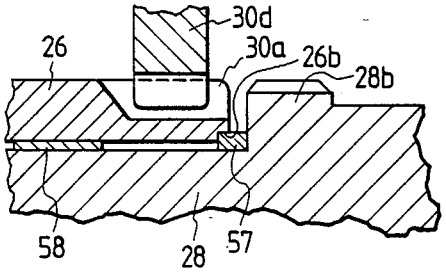
FIG. 4 is a fragmentary sectional view showing the bearing according to a further embodiment of the present invention.
Figure 5:
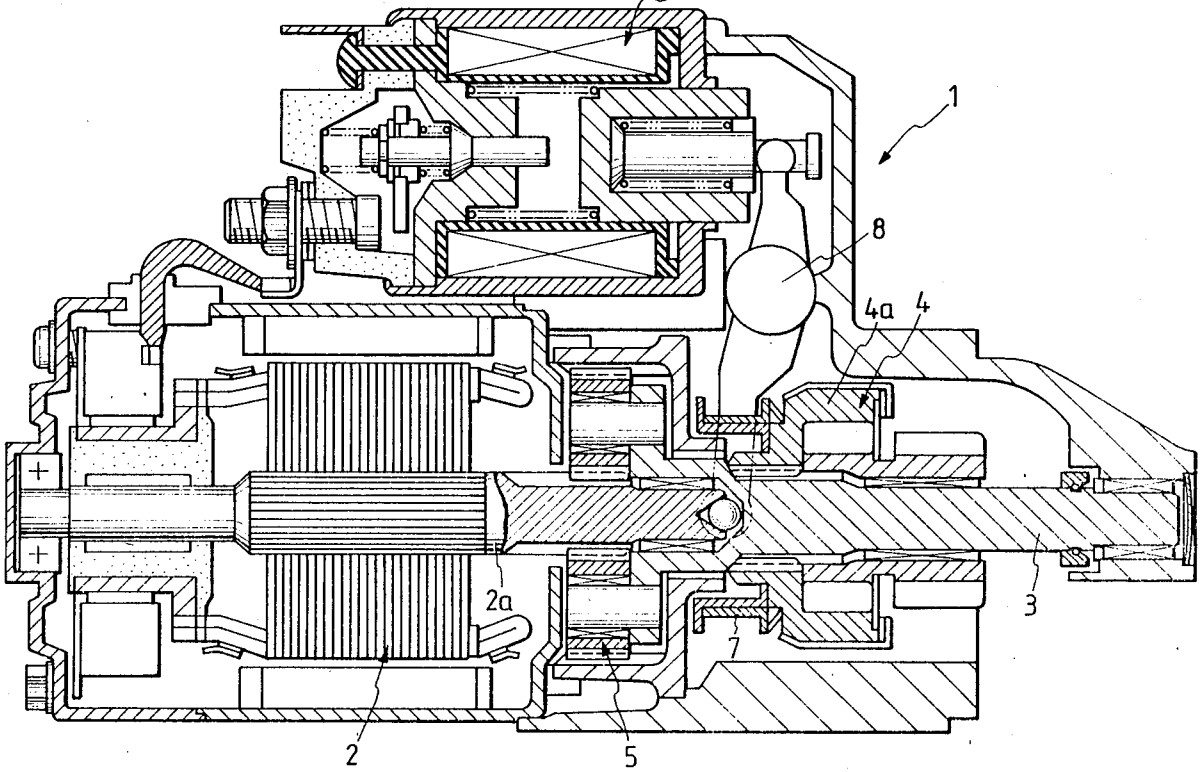
FIG. 5 PRIOR ART
FIG. 5 shows a conventional biaxial starter.

The same effect can be attained by a further embodiment as shown in FIG. 4 in which a large-diameter concavity 26*b*, having a slight length in the axial direction, is formed on the inner circumference in the front end portion of the armature shaft 26 in order to interpose an annular bearing 57 between the front end surface of the armature shaft 26 and the rear end surface of the large-diameter portion of the output shaft 28 to receive only a thrust load so that the annular bearing 57 is fixedly fitted into the large-diameter concavity 26*b*. However, in this case, two parts are required because another bearing 58 must be provided to receive a radial load. Although the embodiment has shown the case where a conventional commutator is used, it is a matter of course that the same effect can be attained when a face type commutator is used. The resin brackets 50 and 51 to which the terminal bolts 46 and 47 are fixed by molding may be connected to each other to form a disk-like body.

As described above, according to the coaxial starter of the present invention, when a part of the output shaft arranged coaxially with respect to the armature shaft tubularly provided in the motor is inserted into the inside path of the armature shaft and supported so as to be slidable in the axial direction, the front end surface of the armature shaft and the rear end surface of the large-diameter portion of the output shaft can be prevented from directly touching each other by the bearing disposed therebetween. Accordingly, abrasion due to the contact therebetween caused by the rotational difference can be prevented. Consequently, the invention can provide a coaxial starter which is extremely durable and reliable.

Also, according to the coaxial starter of the present invention, a space among the brushing units arranged in the surroundings of the commutator in the DC motor is utilized for the arrangement of the terminal bolts with the fixed contacts as constituent parts of the electromagnetic switching unit. As a result, the overall longitudinal length of the starter is reduced.

Furthermore according to the coaxial starter of the present invention, a rod attached to the plunger of the electromagnetic switching unit is shaped like a tube, a force rod is inserted into the tubular rod, and a coiled spring is arranged within the tubular rod so as to exert pressing force to the force rod. The force rod receives the pressing force and exerts an urging force to the output shaft. As a result, a relatively long coiled spring can be used for pressing an force rod without the increase in the overall longitudinal length of the starter. Accordingly, a proper load can be obtained by proper spring stress so that the inventive coaxial starter can be assembled and engine design is simplified.

What is claimed is:

1. A coaxial starter, comprising:

a motor having a tubular armature shaft, an armature core, an armature, and a commutator, said armature and said commutator being attached to said tubular armature shaft, said tubular armature shaft being provided with an inside path thereof and a front end surface thereof perpendicular to an axial direction thereof;

an output shaft arranged at the front end side of said motor and having one end provided with a pinion disengageably engaged with a ring gear of an engine and the other end inserted into said inside path of said tubular armature shaft so as to be axially slidable, said output being provided with a large-diameter portion having a rear end surface thereof;

a driving power transmission device having an overrunning clutch for transmitting rotation force of said armature shaft through said overrunning clutch to said output shaft;

a bearing provided between said front end surface of said armature shaft and said rear end surface of said large-diameter portion of said output shaft;

an electromagnetic switching unit proivded on a rear end side of said motor for energizing said motor and for sliding said output shaft; and wherein said tubular armature shaft is provided with a large-diameter concavity formed on an inner circumferential portion at the front end side of said armature shaft, and said bearing is formed by a tubular member which is inserted into said large-diameter concavity and longer in the axial direction than said large-diameter concavity so as to project from the front end surface of said tubular armature shaft.

2. A coaxial starter as claimed in claim 1, wherein the rear end of said bearing terminates in front of a position where said armature core of said motor is attached to said armature shaft.

3. A coaxial starter, comprising:

a motor having a tubular armature shaft, an armature core, an armature, and a commutator, said armature and said commutator being attached to siad tubular armature shaft, said tubular armature shaft being provided with an inside path thereof having a first inner diameter and a front end surface thereof perpendicular to an axial direction thereof;

an output shaft arranged at the front end side of said motor and having one end provided with a pinion disengageably engaged with a ring gear of an engine and the other end inserted into said inside path of said tubular armature shaft so as to be axially slidable, said output shaft being provided with a large-diameter portion having a diameter larger than said first inner diameter and having a rear end surface thereof, such that said front end surface of said tubular armature shaft and said rear end surface of said output shaft face each other;

a driving power transmission device having an overrunning clutch for transmitting rotation force of said armature shaft through said overrunning clutch to said output shaft;

a bearing provided between said front end surface of said armature shaft and said rear end surface of said large-diameter portion of said output shaft;

an electromagnetic switching unit provided on a rear end side of said motor for energizing said motor and for sliding said output shaft; and wherein said bearing comprises a first bearing portion of a tubular shape for receiving a radial load, which is interposed between the inner circumferential surface of said armature shaft and the outer circumferential surface of said output shaft, and a second bearing portion of a flange shape for receiving a thrust load, which extends radially outward on a front end side of said first bearing portion and is interposed between said front end surface of said armature shaft and said rear surface of said large-diameter portion of said output shaft.

4. A coaxial starter as claimed in claim 3, wherein the rear end of said first bearing portion terminates in front of a position where said armature core of said motor is attached to said armature shaft.

5. A coaxial starter, comprising:

a motor having a tubular armature shaft, an armature core, an armature, and a commutator, said armature and said commutator being attached to said tubular armatue shaft, said tubular armature shaft being provided with an inside path thereof and a front end surface thereof perpendicular to an axial direction thereof;

an output shaft arranged at the front end side of said motor and having one end provided with a pinion disengageably engaged with a ring gear of an engine and the other end inserted into said inside path of said tubular armature shaft so as to be axially slidable, said output shaft being provided with a large-diameter portion having a rear end surface thereof;

a driving power transmission device having an overrunning clutch for transmitting rotation force of said armature shaft through said overrunning clutch to said output shaft;

a bearing provided between said front end surface of said armature shaft and said rear end surface of said large-diameter portion of said output shaft;

an electromagnetic switching unit provided on a rear end side of said motor for energizing said motor and for sliding said output shaft; and wherein said electromagnetic switching unit is provided with a plunger which is moved in the axial direction of said armature shaft when said electromagnetic switching unit is excited, a tubular rod having one end thereof fixed to said plunger and the other end thereof extending in the axial direction of said armature shaft, a force rod having one end thereof slidably inserted into said tubular rod and the other end thereof extending through said inside path of said armature shaft so as to be in contact with an end surface of said output shaft, an insulator, a movable contact held on said tubular rod through said insulator, and a coiled spring arranged within said tubular rod to urge said force rod in the axial direction.

6. A coaxial starter as claimed in claim 5, wherein said tubular rod is made of non-magnetic stainless steel.

7. A coaxial starter, comprising:

a motor having a tubular armature shaft, an armature core, an armature, and a commutator, said armature and said commutator being attached to said tubular armature shaft, said tubular armature shaft being provided with an inside path thereof and a front end surface thereof perpendicular to an axial direction thereof;

an output shaft arranged at the front end side of said motor and having one end provided with a pinion disengageably engaged with a ring gear of an engine and the other end inserted into said inside path of said tubular armature shaft so as to be axially slidable;

a driving power transmission device having an overrunning clutch for transmitting rotation force of said armature shaft through said overrunning clutch to said output shaft;

an electromagnetic switching unit provided on a rear end side of said motor for energizing said motor and for sliding said output shaft; and further comprising:

a frame of said motor;

a movable contact provided in said electromagnetic switching unit;

a plurality of brushing units arranged at equal intervals around said commutator;

at least one terminal bolt connected to one terminal of an electric source, said at least one terminal bolt being attached to said frame between said plurality of brushing units; and a pair of fixed contacts, one of said fixed contacts comprising said at least one terminal bolt and a respective extension thereof, said fixed contacts coming into contact with said movable contact in response to movement of said movable contact to a predetermined position.

* * * * *